US012274320B2

(12) United States Patent
Ino

(10) Patent No.: US 12,274,320 B2
(45) Date of Patent: Apr. 15, 2025

(54) CORE-SHEATH COMPOSITE FIBER FOR ARTIFICIAL HAIR, HEADWEAR PRODUCT INCLUDING SAME, AND PRODUCTION METHOD FOR SAME

(71) Applicant: KANEKA CORPORATION, Osaka (JP)

(72) Inventor: Yurina Ino, Osaka (JP)

(73) Assignee: KANEKA CORPORATION, Osaka (JP)

( * ) Notice: Subject to any disclaimer, the term of this patent is extended or adjusted under 35 U.S.C. 154(b) by 354 days.

(21) Appl. No.: 17/883,100

(22) Filed: Aug. 8, 2022

(65) Prior Publication Data

US 2022/0400799 A1 Dec. 22, 2022

Related U.S. Application Data

(63) Continuation of application No. PCT/JP2021/000048, filed on Jan. 5, 2021.

(30) Foreign Application Priority Data

Mar. 3, 2020 (JP) ..... 2020-036162

(51) Int. Cl.
*A41G 3/00* (2006.01)
*D01D 5/10* (2006.01)
(Continued)

(52) U.S. Cl.
CPC ..... *A41G 3/0083* (2013.01); *D01D 5/10* (2013.01); *D01F 1/06* (2013.01); *D01F 8/12* (2013.01); *D01F 8/14* (2013.01)

(58) Field of Classification Search
CPC ..... A41G 3/0083; D01D 5/10; D01F 1/06; D01F 8/12; D01F 8/14
See application file for complete search history.

(56) References Cited

U.S. PATENT DOCUMENTS 5,834,089 A * 11/1998 Jones ..... D01F 8/12 528/339
12,031,241 B2 * 7/2024 Sakamoto ..... A41G 3/0083
(Continued)

FOREIGN PATENT DOCUMENTS

EP 1852022 A1 11/2007
EP 3603432 A1 2/2020
(Continued)

OTHER PUBLICATIONS

International Search Report issued in corresponding International Application No. PCT/JP2021/000048, mailed Mar. 9, 2021 (6 pages).
(Continued)

*Primary Examiner* — Jeremy R Pierce
(74) *Attorney, Agent, or Firm* — Osha Bergman Watanabe & Burton LLP

(57) ABSTRACT

A core-sheath conjugate fiber for artificial hair includes a core part and a sheath part. The core-sheath conjugate fiber for artificial hair is a colored fiber. The core part has a lightness L* of 10 or less in the CIE1976 color space and the sheath part has a lightness L* of 15 or more in the CIE1976 color space. With this configuration, the core-sheath conjugate fiber for artificial hair that has deep and natural colors similar to those of human hair and a good appearance, a hair ornament product including the same, and a method for producing the same are provided.

20 Claims, 1 Drawing Sheet

(51) Int. Cl.

| | |
|---|---|
| ***D01F 1/06*** | (2006.01) |
| ***D01F 8/12*** | (2006.01) |
| ***D01F 8/14*** | (2006.01) |

(56) References Cited

U.S. PATENT DOCUMENTS

| | | | | |
|---|---|---|---|---|
| 2004/0168426 | A1* | 9/2004 | Shigemura ..... | D02G 3/328<br>57/225 |
| 2009/0126749 | A1 | 5/2009 | Shirakashi et al. | |
| 2019/0090565 | A1 | 3/2019 | Miyata et al. | |
| 2020/0024774 | A1 | 1/2020 | Yasutomo et al. | |

FOREIGN PATENT DOCUMENTS

| | | | |
|---|---|---|---|
| JP | 848-10817 | B1 | 4/1973 |
| JP | 849-12312 | B1 | 3/1974 |
| JP | 860-173142 | A | 9/1985 |
| JP | 2000-234217 | A | 8/2000 |
| JP | 2008-163487 | A | 7/2008 |
| WO | 2006/087911 | A1 | 8/2006 |
| WO | 2017/187843 | A1 | 11/2017 |
| WO | 2018/179803 | A1 | 10/2018 |

OTHER PUBLICATIONS

Written Opinion issued in corresponding International Application No. PCT/JP2021/000048, mailed Mar. 9, 2021 (4 bages).

* cited by examiner

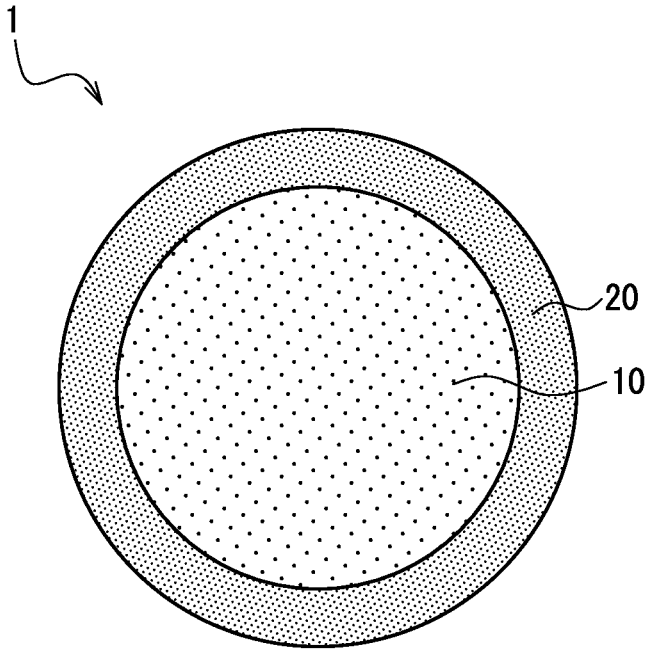
1
20
10

CORE-SHEATH COMPOSITE FIBER FOR ARTIFICIAL HAIR, HEADWEAR PRODUCT INCLUDING SAME, AND PRODUCTION METHOD FOR SAME

CROSS-REFERENCE TO RELATED APPLICATIONS

This application is a continuation of International Application Serial No. PCT/JP2021/000048, filed on Jan. 5, 2021, which in turn claims priority to Japanese Patent Application No. 2020-036162, filed on Mar. 3, 2020.

TECHNICAL FIELD

One or more embodiments of the present invention relate to a core-sheath conjugate fiber for artificial hair capable of being used as an alternative to human hair, a hair ornament product including the same, and a production method therefor.

BACKGROUND

Conventionally, human hair is used for hair ornament products such as hairpieces, hair wigs, hair extensions, hair bands, and doll hair. However, in recent years, it is becoming difficult to obtain human hair, and thus there is an increasing demand for artificial hair capable of being used as an alternative to human hair. Examples of synthetic fibers that can be used for artificial hair include acrylic-based fibers, vinyl chloride-based fibers, vinylidene chloride-based fibers, polyester-based fibers, polyamide-based fibers, and polyolefin-based fibers. In particular, a core-sheath conjugate fiber containing polyester as a core component and polyamide as a sheath component has been developed as a fiber for artificial hair having a texture close to that of human hair and excellent durability and heat resistance (Patent Document 1).

Patent Document

Patent Document 1: WO 2017/187843

However, the fiber for artificial hair described in Patent Document 1 has a monochromatic and monotonous color, and it was difficult to realize deep and natural hues like those of human hair.

In order to address the above, one or more embodiments of the present invention provide a core-sheath conjugate fiber for artificial hair that has deep and natural colors similar to those of human hair and a good appearance, a hair ornament product including the same, and a method for producing the same.

SUMMARY

One or more embodiments of the present invention relate to a core-sheath conjugate fiber for artificial hair including a core part and a sheath part, wherein the core-sheath conjugate fiber for artificial hair is a colored fiber, the core part has a lightness L* of 10 or less in the CIE1976 color space, and the sheath part has a lightness L* of 15 or more in the CIE1976 color space.

One or more embodiments of the present invention relate to a hair ornament product including the core-sheath conjugate fiber for artificial hair.

One or more embodiments of the present invention relate to a method for producing the core-sheath conjugate fiber for artificial hair, including: a step of melt spinning a core part resin composition and a sheath part resin composition using a core-sheath conjugate nozzle; and a step of dyeing the core-sheath conjugate fiber for artificial hair, wherein at least the core part resin composition contains a pigment.

According to one or more embodiments of the present invention, it is possible to provide a core-sheath conjugate fiber for artificial hair that has deep and natural colors similar to those of human hair and a good appearance, and a hair ornament product including the same.

Furthermore, according to the production method of one or more embodiments of the present invention, it is possible to obtain a core-sheath conjugate fiber for artificial hair that has deep and natural colors similar to those of human hair and a good appearance.

BRIEF DESCRIPTION OF THE DRAWINGS

FIG. 1 is a schematic view showing a fiber cross section of a core-sheath conjugate fiber for artificial hair according to one or more embodiments of the present invention.

DETAILED DESCRIPTION

The inventor of one or more embodiments of the present invention conducted an in-depth research in order to address the above, and found that, when a core-sheath conjugate fiber for artificial hair including a core part and a sheath part is colored, and the core part has a lightness L* of 10 or less in the CIE1976 color space and the sheath part has a lightness L* of 15 or more in the CIE1976 color space, the core-sheath conjugate fiber for artificial hair can have deep and natural hues and appearance similar to those of human hair, and thus one or more embodiments of the present invention were achieved. Preferably, a pigment is contained at least in the core part and the core part and the sheath part are dyed, in which case, it is easy to make the core part have a lightness L* of 10 or less in the CIE1976 color space and make the sheath part have a lightness L* of 15 or more in the CIE1976 color space.

Lightness

Lightness L* (hereinafter also simply referred to as "L*") is used in the CIE1976 (L*, a*, b*) color space, which is widely used in industrial fields as a color space that is perceptually uniform for humans, and is measured using an ordinary color-difference meter. Note that a* (with positive values toward red and negative values toward green) and b* (with positive values toward yellow and negative values toward blue) mean chromaticity.

It seems that, since human hair has a complex structure comprised of a plurality of layers such as the cuticle, the cortex, and the medulla, light reflected thereby provides various colors, and a deep and complex appearance unique to human hair is expressed. On the other hand, in an ordinary core-sheath fiber for artificial hair, the core part and the sheath part have the same color in order to simplify the production processes, and thus its appearance becomes monochromatic and monotonous.

Under the above circumstances, if a core-sheath conjugate fiber for artificial hair (hereinafter also simply referred to as a "core-sheath conjugate fiber") is colored, and the core part has a lightness L* of 10 or less and the sheath part has a lightness L* of 15 or more after the coloring, the core part and the sheath part have different colors, and it is possible to realize deep colors and a complex appearance due to such a core-sheath structure. The lightness L* of the sheath part may be 24 or more. The lightness L* of the core part may be 8 or less and the lightness L* of the sheath part may be 24 or more. Furthermore, from the viewpoint of making the dyed core-sheath conjugate fiber have deep and natural hues and appearance similar to those of human hair, in one or more embodiments, the lightness L* of the core part may be 5 or more, although there is no limitation thereto. Also, from the viewpoint of making the dyed core-sheath conjugate fiber have deep and natural hues and appearance similar to those of human hair, in one or more embodiments, the lightness L* of the sheath part may be 40 or less, although there is no limitation thereto.

If the lightness L* value of the sheath part is larger than the lightness L* value of the core part, when light that has passed through the sheath part and has reflected off the core part surface again passes through the sheath part and appears on the outer surface, the light appears on the outer surface without being attenuated by the sheath part, and thus not only light that has reflected off the sheath part surface but also the light that has reflected off the core part surface affects color tones, which makes it easy to realize deep colors. On the other hand, if the lightness L* value of the sheath part is smaller than the lightness L* value of the core part, when light that has passed through the sheath part and has reflected off the core part surface again passes through the sheath part and appears on the outer surface, the light is attenuated by the sheath part, and thus it is difficult to realize deep colors. Also, when a combination of similar colors is adopted for the core part and the sheath part, it is not easy to make a large difference between the color of the core part and the color of the sheath part, and it is difficult to realize deep colors.

Specifically, a deep and complex appearance close to that of human hair can be realized by adopting colors that significantly differ from each other, such as a combination of black and beige, for the core part and the sheath part. A dark color may be adopted for the core part and a light color may be adopted for the sheath part, in which case, a deeper appearance can be obtained when compared with a case where a light color is adopted for the core part and a dark color is adopted for the sheath part and a case where dark colors are adopted for the core part and the sheath part.

Coloring Method

The core-sheath conjugate fiber for artificial hair can be colored through spun-dyeing and/or dyeing.

Spun-Dyeing

In the core-sheath conjugate fiber for artificial hair, at least the core part is spun-dyed. In one or more embodiments of the present invention, spun-dyeing means coloring performed by adding a pigment to a resin composition that is to be used as a raw material, and, for example, it is possible to obtain a core-sheath conjugate fiber for artificial hair with a desired color by adding an ordinary pigment such as carbon black or an anthraquinone-based pigment to the resin composition. It is also possible to use a pigment masterbatch instead of using a pigment. The pigment masterbatch is obtained by kneading and pelletizing (which may be referred to as "compounding") a pigment and a resin composition using a kneader such as an extruder, wherein the pigment, which is typically difficult to handle due to its fine powder form, is dispersed in advance in the resin composition, and thus it is possible to easily handle the pigment and to suppress color spots of the obtained fiber.

Furthermore, in the case of fibers for hair that are required to have a large number of colors, it is preferable to obtain a fiber that is spun-dyed to have a desired color by using several specific types of pigment masterbatches and adjusting the addition ratio of the masterbatches, from the viewpoint of simplifying the production and reducing the pigment inventory cost. In particular, it is possible to obtain a fiber with a desired color by using three types of pigment masterbatches of black, red, and yellow and adjusting the blending ratio of the masterbatches. For example, if 20-wt % pigment masterbatches are blended at the ratio of black:red:yellow=60:25:15 (parts by weight), and 3.0 parts by weight of the obtained pigment is added with respect to 100 parts by weight of base resin, it is possible to obtain a black conjugate fiber for artificial hair.

Dyeing

In the core-sheath conjugate fiber for artificial hair, the core part and/or the sheath part is dyed. In one or more embodiments of the present invention, dyeing means a method of obtaining a colored fiber by causing a dye to be bonded to and adsorbed by a fiber after shaping (spinning), and it is possible to use, for example, a dispersed dye, an acidic dye, a basic dye, or the like according to the fiber material. When the fiber is colored through dyeing, it is possible to use a dyeing method similar to dyeing methods commonly used when synthetic fibers such as polyester-based fibers and polyamide-based fibers are dyed. From the viewpoint of dyeing at least the sheath part, dyeing may be performed using a method similar to that used when a fiber constituted only by a sheath part resin composition is dyed. The core part and the sheath part may be both dyed. Dyes such as a black dye, a yellow dye, a red dye, and a brown dye can be used as desired in a post-dyeing method, and two or more dyes may also be mixed to adjust the color. Dispersed dyes may be used as the dyes, and specific examples thereof include benzene azo (monoazo, disazo, etc.,) dyes, heterocyclic azo (thiazole azo, benzothiazole azo, thiophene azo, etc.,) dyes, anthraquinone dyes, and condensed (quinophthalone, styryl, coumarin, etc.,) dyes. Dyeing may be performed at a temperature of 90° C. or more and 150° C. or less, or 100° C. or more and 140° C. or less. Also, it is preferable to adjust a dyebath containing a dye to a suitable pH. Also, a dye auxiliary may be used together with a dye in the post-dyeing method to increase fixity and dispersibility. Examples of the dye auxiliary include a dispersant, a level dyeing agent, and an oligomer removing agent.

Specific examples of the dye auxiliary include a formaldehyde condensate of naphthalene-sulfonic acid, polyoxyalkylene alkyl aryl ether, polyoxyalkylene alkyl ester, polyoxyalkylene alkyl aryl ether sulfate, and polyoxyalkylene aryl ether sulfate. The dye auxiliary may be used in the range of 0.5 g/L or more and 2 g/L or less with respect to the dyebath.

As a pH adjuster, it is possible to use a combination of acetic acid and sodium acetate, a combination of acetic acid and sodium pyrophosphate, or a combination of polycarboxylic acid and either sodium dihydrogenphosphate or an organic phosphorus compound, for example. The pH adjuster may be used in the range of 0.5 g/L or more and 2 g/L or less with respect to the dyebath.

The dye used in the dyeing method may be taken into the core-sheath conjugate fiber for artificial hair in an amount of 0.1% by mass or more. The uptake amount of the dye needs to be adjusted appropriately according to the color of the core-sheath conjugate fiber for artificial hair, because there is a wide variety of colors for the core-sheath conjugate fiber from dark colors like that of black hair to intermediate colors like those of brown hair and red hair, and light colors like those of blond hair and white (grey) hair. The uptake amount of the dye can be adjusted by adjusting the concentration of the dyebath, the dyeing temperature, and the dyeing time.

It is preferable that the pigment, the dye, the dye auxiliary, and the like used in the core-sheath conjugate fiber for artificial hair have weather resistance and flame retardance.

As necessary, the core-sheath conjugate fiber for artificial hair may contain various types of additives such as a heat-resistant agent, a stabilizer, a fluoresces, an antioxidant, and an antistatic agent. For example, stearyl acid phosphate or the like can be used as the stabilizer.

When spun-dyeing and dyeing are performed in combination, it is possible to use a coloring method such as a method of dyeing a fiber that is spun-dyed in advance or a method of spun-dyeing the core and dyeing the sheath, according to properties of resins used for the core and the sheath.

From the viewpoint of easily controlling the lightness L* of the core part to be 10 or less, it is preferable to add a pigment to at least the core part of the core-sheath conjugate fiber for artificial hair, and it is more preferable to use three types of pigment masterbatches of black, red, and yellow as the pigment and adjust the blending ratio of the masterbatches.

Shape of Core-Sheath Conjugate Fiber

The core-sheath conjugate fiber for artificial hair includes the core part and the sheath part and has a core-sheath structure. The cross sectional shape of the core-sheath conjugate fiber for artificial hair and the cross sectional shape of the core part are not particularly limited, and may be circular shapes or other shapes. For example, the core-sheath conjugate fiber and the core part may have other cross sectional shapes that are at least one type of shape selected from the group consisting of an elliptical shape, a flat multilobed shape, a crossing circle shape, a cocoon shape, a Daruma doll shape, a dog-bone shape, and a ribbon shape. From the viewpoint of esthetic characteristics such as gloss, texture, combing property, and curl retention properties, the fiber and the core part may have the same flat multilobed cross sectional shape in which the major axis direction of the fiber cross section and the major axis direction of the core part substantially match each other. If the fiber and the core part have cross sections with the same flat multilobed shape in which the major axis direction of the fiber cross section and the major axis direction of the core part cross section substantially match each other, in the fiber cross section, the outer peripheral shape of the fiber cross section and the outer peripheral shape of the core part are similar to each other, and thus the thickness of the sheath is uniform, and it is possible to prevent the core part from being exposed to the surface, while maintaining a good touch and appearance as artificial hair. Furthermore, since the fiber and the core part have the flat multilobed cross sectional shape, the core-sheath interface include recessed portions and protrusions. Accordingly, stress that is generated at the core-sheath interface due to deformation such as bending can be dispersed, and thus it is possible to prevent the two components of the fiber from separating from each other. Furthermore, since the major axis directions of the fiber cross section and the core part cross section substantially match each other, the entire fiber and the core part have the same anisotropy of the modulus of elasticity in bending resulting from the moment of inertia of area, and thus it is easy to adjust the quality required for artificial hair, such as a touch and the combing property.

FIG. 1 is a schematic view showing a fiber cross section of a core-sheath conjugate fiber for artificial hair. The core-sheath conjugate fiber 1 for artificial hair shown in FIG. 1 includes a core part 10 and a sheath part 20, the major axis direction of the fiber cross section and the major axis direction of the core part cross section match each other, the cross sectional shape of the core-sheath conjugate fiber 1 for artificial hair and the cross sectional shape of the core part 10 are both circular shapes, and the core part 10 is arranged concentrically with the core-sheath conjugate fiber 1 for artificial hair.

The above-described cross sectional shapes of the fiber and the core part and the core-to-sheath area ratio can be controlled by using nozzle pores with a shape close to the target cross sectional shape.

The core-to-sheath area ratio (ratio between the core part and the sheath part) in a fiber cross section of the core-sheath conjugate fiber for artificial hair is not particularly limited, but from the viewpoint of realizing a complex appearance and stability of spinning and the cross section, for example, it is preferably in the range of core:sheath=1:9 to 9:1, more preferably 2:8 to 8:2, and even more preferably 3:7 to 7:3.

From the viewpoint of suitability for artificial hair, the core-sheath conjugate fiber for artificial hair has a fiber fineness of preferably 10 dtex or more and 150 dtex or less, more preferably 30 dtex or more and 120 dtex or less, even more preferably 40 dtex or more and 100 dtex or less, and even more preferably 50 dtex or more and 90 dtex or less.

Composition of Core-Sheath Conjugate Fiber

The composition of the core-sheath conjugate fiber for artificial hair is not particularly limited, and the core-sheath conjugate fiber for artificial hair may be comprised of, for example, a thermoplastic resin composition such as an acrylonitrile-based resin composition, a vinyl chloride-based resin composition, a vinylidene chloride-based resin composition, a polyester-based resin composition, a polyamide-based resin composition, or a polyolefin-based resin composition. Furthermore, these resin compositions may be used in a combination of two or more. Furthermore, from the viewpoint of flame retardance, a flame retardant may also be used, and a polyester-based resin composition containing a polyester-based resin and a bromine-based polymer flame retardant, a polyamide-based resin composition containing a polyamide-based resin and a bromine-based polymer flame retardant, and the like may be used. Examples of flame-retardant resin compositions include a resin composition containing 100 parts by weight of one or more of resins selected from the group consisting of polyalkylene terephthalate, a copolymerized polyester mainly containing polyalkylene terephthalate, and polyamide, and 5 parts by weight or more and 40 parts by weight or less of a bromine-based polymer flame retardant.

Of these compositions, a polyester-based resin composition and a polyamide-based resin composition may be used from the viewpoint of satisfactory heat resistance and fiber physical properties required for a fiber for artificial hair and relatively good handleability in processing steps such as resin processing, spinning, drawing, and heat treatment, and a flame-retardant resin composition may be used for one or both of the core part and the sheath part from the viewpoint of safety.

Polyalkylene terephthalate is not particularly limited, and may be, for example, polyethylene terephthalate, polypropylene terephthalate, polybutylene terephthalate, or polycyclohexane dimethylene terephthalate. The copolymerized polyester mainly containing polyalkylene terephthalate is not particularly limited, and may be, for example, a copolymerized polyester mainly containing polyalkylene terephthalate such as polyethylene terephthalate, polypropylene terephthalate, polybutylene terephthalate, or polycyclohexane dimethylene terephthalate, and further containing other copolymerizable components. The "copolymerized polyester mainly containing polyalkylene terephthalate" refers to a copolymerized polyester containing polyalkylene terephthalate in an amount of 80 mol % or more.

Examples of the other copolymerizable components include: polycarboxylic acids such as isophthalic acid, orthophthalic acid, naphthalenedicarboxylic acid, paraphenylenedicarboxylic acid, trimellitic acid, pyromellitic acid, succinic acid, glutaric acid, adipic acid, suberic acid, azelaic acid, sebacic acid, and dodecanedioic acid, and their derivatives; dicarboxylic acids and their derivatives containing sulfonates such as 5-sodiumsulfoisophthalic acid and dihydroxyethyl 5-sodiumsulfoisophthalate; 1,2-propanediol; 1,3-propanediol; 1,4-butanediol; 1,6-hexanediol; neopentyl glycol; 1,4-cyclohexanedimethanol; diethylene glycol; polyethylene glycol; trimethylolpropane; pentaerythritol; 4-hydroxybenzoic acid; ε-caprolactone; and an ethylene glycol ether of bisphenol A.

The copolymerized polyester may be produced by adding a small amount of other copolymerizable components to polyalkylene terephthalate serving as a main component, and allowing them to react with each other, from the viewpoint of stability and ease of operation. Examples of the polyalkylene terephthalate include a polymer of terephthalic acid and/or its derivatives (e.g., methyl terephthalate) and alkylene glycol. The copolymerized polyester may be produced by adding a small amount of monomer or oligomer component serving as other copolymerizable components, to a mixture of terephthalic acid and/or its derivatives (e.g., methyl terephthalate) and alkylene glycol, used for polymerization of polyalkylene terephthalate serving as a main component, and subjecting them to polymerization.

It is sufficient that the copolymerized polyester has a structure in which the other copolymerizable components are polycondensed on the main chain and/or side chain of polyalkylene terephthalate serving as a main component, and the copolymerization method and the like are not particularly limited.

Specific examples of the copolymerized polyester mainly containing polyalkylene terephthalate include a polyester obtained through copolymerization of polyethylene terephthalate serving as a main component with one compound selected from the group consisting of an ethylene glycol ether of bisphenol A, 1,4-cyclohexanedimethanol, isophthalic acid, and dihydroxyethyl 5-sodiumsulfoisophthalate.

Polyalkylene terephthalate and the copolymerized polyester mainly containing polyalkylene terephthalate may be used alone or in a combination of two or more. In particular, polyethylene terephthalate (hereinafter also referred to as "PET"); polypropylene terephthalate; polybutylene terephthalate (hereinafter also referred to as "PBT"); a polyester obtained through copolymerization of polyethylene terephthalate serving as a main component with an ethylene glycol ether of bisphenol A; a polyester obtained through copolymerization of polyethylene terephthalate serving as a main component with 1,4-cyclohexanedimethanol; a polyester obtained through copolymerization of polyethylene terephthalate serving as a main component with isophthalic acid; a polyester obtained through copolymerization of polyethylene terephthalate serving as a main component with dihydroxyethyl 5-sodiumsulfoisophthalate, and the like may be used alone or in a combination of two or more.

The polyamide-based resin means a nylon resin obtained through polymerization of one or more selected from the group consisting of lactam, aminocarboxylic acid, a mixture of dicarboxylic acid and diamine, a mixture of a dicarboxylic acid derivative and diamine, and a salt of dicarboxylic acid and diamine.

Specific examples of the lactam include, but are not particularly limited to, for example, 2-azetidinone, 2-pyrrolidinone, 6-valerolactam, ε-caprolactam, enantholactam, capryllactam, undecalactam, and laurolactam. Of these lactams, it is preferable to use 8-caprolactam, undecalactam, and laurolactam, and more preferable to use ε-caprolactam. These lactams may be used alone or in a combination of two or more.

Specific examples of the aminocarboxylic acid include, but are not particularly limited to, for example, 6-aminocaproic acid, 7-aminoheptanoic acid, 8-aminooctanoic acid, 9-aminononanoic acid, 10-aminodecanoic acid, 11-aminoundecanoic acid, and 12-aminododecanoic acid. Of these aminocarboxylic acids, it is preferable to use 6-aminocaproic acid, 11-aminoundecanoic acid, and 12-aminododecanoic acid, and more preferable to use 6-aminocaproic acid. These aminocarboxylic acids may be used alone or in a combination of two or more.

Specific examples of the dicarboxylic acid that can be used for the mixture of dicarboxylic acid and diamine, the mixture of a dicarboxylic acid derivative and diamine, or the salt of dicarboxylic acid and diamine include, but are not particularly limited to, for example: aliphatic dicarboxylic acids such as oxalic acid, malonic acid, succinic acid, glutaric acid, adipic acid, pimelic acid, suberic acid, azelaic acid, sebacic acid, undecanedioic acid, dodecanedioic acid, brasylic acid, tetradecanedioic acid, pentadecanedioic acid, and octadecanedioic acid; alicyclic dicarboxylic acids such as cyclohexane dicarboxylic acid; and aromatic dicarboxylic acids such as phthalic acid, isophthalic acid, terephthalic acid, and naphthalenedicarboxylic acid. Of these dicarboxylic acids, it is preferable to use adipic acid, sebacic acid, dodecanedioic acid, terephthalic acid, and isophthalic acid, and more preferable to use adipic acid, terephthalic acid, and isophthalic acid. These dicarboxylic acids may be used alone or in a combination of two or more.

Specific examples of the diamine that can be used for the mixture of dicarboxylic acid and diamine, the mixture of a dicarboxylic acid derivative and diamine, or the salt of dicarboxylic acid and diamine include, but are not particularly limited to, for example: aliphatic diamines such as 1,4-diaminobutane, 1,5-diaminopentane, 1,6-diaminohexane, 2-methyl-1,5-diaminopentane (MDP), 1,7-diaminoheptane, 1,8-diaminooctane, 1,9-diaminononan, 1,10-diaminodecane, 1,11-diaminoundecane, 1,12-diaminododecane, 1,13-diaminotridecane, 1,14-diaminotetradecane, 1,15-diaminopentadecane, 1,16-diaminohexadecane, 1,17-diaminoheptadecane, 1,18-diaminooctadecane, 1,19-diaminononadecane, and 1,20-diaminoeicosane; alicyclic diamines such as cyclohexanediamine and bis-(4-aminohexyl)methane; and aromatic diamines such as m-xylylenediamine and p-xylylenediamine. Of these diamines, it is preferable to use an aliphatic diamine, and more preferable to use hexamethylenediamine. These diamines may be used alone or in a combination of two or more.

The polyamide-based resin is not particularly limited, but it is preferable to use, for example, Nylon 6 (hereinafter also referred to as "PM"), Nylon 66 (hereinafter also referred to as "PA66"), Nylon 11, Nylon 12, Nylon 6/10, Nylon 6/12, semi-aromatic nylon containing the Nylon 6T and/or 61 unit, copolymers of these nylon resins, or the like. It is more preferable to use Nylon 6, Nylon 66, or a copolymer of Nylon 6 and Nylon 66.

The polyamide-based resin can be produced for example, using a polyamide-based resin polymerization method in which a raw material for the polyamide-based resin is heated in the presence or absence of a catalyst. During the polymerization, stirring may or may not be performed, but it is preferable to perform stirring in order to obtain a uniform product. The polymerization temperature can be set as appropriate according to the degree of polymerization, the reaction yield, and the reaction time of a target polymer, but it is preferable to set the temperature to a low temperature in consideration of the quality of a finally obtained polyamide-based resin. The reaction ratio can also be set as appropriate. The pressure is not limited, but it is preferable to reduce the pressure in the system in order to efficiently let volatile components move to the outside of the system.

The polyamide-based resin may have a terminal end that is capped by an end-capping agent such as a carboxylic acid compound or an amine compound as necessary. The concentration of terminal amino groups or terminal carboxyl groups in a nylon resin obtained when a terminal end is capped by adding monocarboxylic acid or monoamine is lower than that when such an end-capping agent is not used. On the other hand, the total concentration of terminal amino groups and terminal carboxyl groups does not change when a terminal end is capped by dicarboxylic acid or diamine, but the concentration ratio between terminal amino groups and terminal carboxyl groups changes.

Specific examples of the carboxylic acid compound include, but are not particularly limited to, for example: aliphatic monocarboxylic acids such as acetic acid, propionic acid, butyric acid, valeric acid, caproic acid, enanthic acid, caprylic acid, pelargonic acid, undecanoic acid, lauric acid, tridecanoic acid, myristic acid, myristoleic acid, palmitic acid, stearic acid, oleic acid, linoleic acid, and arachic acid; alicyclic monocarboxylic acids such as cyclohexanecarboxylic acid and methylcyclohexanecarboxylic acid; aromatic monocarboxylic acids such as benzoic acid, toluic acid, ethylbenzoic acid, and phenylacetic acid; aliphatic dicarboxylic acids such as oxalic acid, malonic acid, succinic acid, glutaric acid, adipic acid, pimelic acid, suberic acid, azelaic acid, sebacic acid, undecanedioic acid, dodecanedioic acid, brasylic acid, tetradecanedioic acid, pentadecanedioic acid, and octadecanedioic acid; alicyclic dicarboxylic acids such as cyclohexanedicarboxylic acid; and aromatic dicarboxylic acids such as phthalic acid, isophthalic acid, terephthalic acid, and naphthalenedicarboxylic acid.

Specific examples of the amine compound include, but are not particularly limited to, for example: aliphatic monoamines such as butylamine, pentylamine, hexylamine, heptylamine, octylamine, 2-ethylhexylamine, nonylamine, decylamine, undecylamine, dodecylamine, tridecylamine, tetradecylamine, pentadecylamine, hexadecylamine, octadecylamine, nonadecylamine, and icosylamine; alicyclic monoamines such as cyclohexylamine and methylcyclohexylamine; aromatic monoamines such as benzylamine and ß-phenylethylamine; aliphatic diamines such as 1,4-diaminobutane, 1,5-diaminopentane, 1,6-diaminohexane, 1,7-diaminoheptane, 1,8-diaminooctane, 1,9-diaminononan, 1,10-diaminodecane, 1,11-diaminoundecane, 1,12-diaminododecane, 1,13-diaminotridecane, 1,14-diaminotetradecane, 1,15-diamino pentadecane, 1,16-diaminohexadecane, 1,17-diaminoheptadecane, 1,18-diaminooctadecane, 1,19-diaminononadecane, and 1,20-diaminoeicosane; alicyclic diamines such as cyclohexanediamine and bis-(4-aminohexyl)methane; and aromatic diamines such as xylylenediamine.

The terminal group concentration of the polyamide-based resin is not particularly limited, but the terminal amino group concentration may be high, for example, when it is necessary to increase the dyeability for fiber uses or when designing a material suitable for alloying for resin uses. On the other hand, the terminal amino group concentration may be low, for example, when it is required to suppress coloring or gelation under extended aging conditions. Furthermore, the terminal carboxyl group concentration and the terminal amino group concentration may be both low when it is required to suppress reproduction of lactam during remelting, yarn breakage during melt spinning due to production of oligomer, mold deposit during continuous injection molding, and generation of die marks during continuous extrusion of a film. It is preferable to adjust the terminal group concentration according to the applications, but the terminal amino group concentration and the terminal carboxyl group concentration both may be $1.0\times10^{-5}$ to $15.0\times10^{-5}$ eq/g, $2.0\times10^{-5}$ to $12.0\times10^{-5}$ eq/g, or $3.0\times10^{-5}$ to $11.0\times10^{-5}$ eq/g.

Furthermore, the end-capping agent may be added using a method in which the end-capping agent is added simultaneously with raw materials such as caprolactam at the initial stage of polymerization, a method in which the end-capping agent is added during polymerization, a method in which the end-capping agent is added when a nylon resin in a molten state is caused to pass through a vertical stirring thin-film evaporator, or the like. The end-capping agent may be added without any treatment, or in the form of being dissolved in a small amount of solvent.

The intrinsic viscosity (alternatively referred to as "IV value") of each of the polyester-based resin and the polyamide-based resin is not particularly limited, but it may be 0.3 or more and 1.2 or less, or 0.4 or more and 1.0 or less. If the intrinsic viscosity is 0.3 or more, the mechanical strength of the obtained fiber does not decrease, and there is no risk of dripping during a combustion test. On the other hand, if the intrinsic viscosity is 1.2 or less, the molecular weight is not too large, and the melt viscosity is not too high, and thus it is easy to perform melt spinning, and the fineness is likely to be uniform.

The bromine-based polymer flame retardant is not particularly limited, but it is preferable to use a brominated epoxy-based flame retardant, for example, from the viewpoint of heat resistance and flame retardance. A brominated epoxy-based flame retardant having an epoxy group or tribromophenol at a molecular end thereof may be used as a raw material. The structure of the brominated epoxy-based flame retardant after melt kneading is not particularly limited, but it is preferable that 80 mol % or more of the structure is comprised of a constituent unit represented by the chemical formula (1) below when the total number of constituent units each represented by the chemical formula (1) below and constituent units obtained by at least partially modifying the chemical formula (1) below is taken as 100 mol %. The structure of the brominated epoxy-based flame retardant may change at a molecular end thereof after melt kneading. For example, a molecular end of the brominated epoxy-based flame retardant may be substituted by a hydroxyl group, a phosphate group, a phosphonic acid group, or the like other than an epoxy group or tribromophenol, or may be bound to a polyester component through an ester group.

(1)

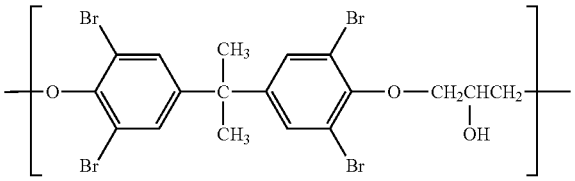

Furthermore, part of the structure of the brominated epoxy-based flame retardant, other than the molecular end, may be changed. For example, the brominated epoxy-based flame retardant may have a branched structure in which the secondary hydroxyl group and the epoxy group are bound. Also, part of the bromine of the chemical formula (1) may be eliminated or added, as long as the bromine content in the molecules of the brominated epoxy-based flame retardant does not change significantly.

For example, a polymeric brominated epoxy-based flame retardant as represented by the chemical formula (2) below may be used as the brominated epoxy-based flame retardant. In the chemical formula (2) below, m is 1 to 1000. Examples of the polymeric brominated epoxy-based flame retardant represented by the chemical formula (2) below include a commercially available product such as a brominated epoxy-based flame retardant (product name "SR-T2MP") manufactured by Sakamoto Yakuhin Kogyo Co., Ltd.

(2)

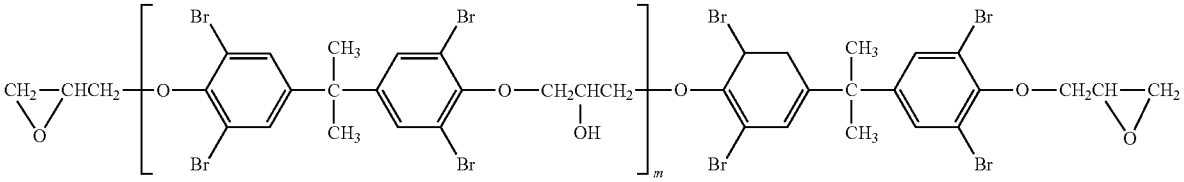

From the viewpoint of obtaining a touch and appearance closer to those of human hair and further improving curling properties and curl retention properties, it is preferable that the core part of the core-sheath conjugate fiber for artificial hair is comprised of a polyester-based resin composition containing, specifically, as a main component resin, one or more of polyester-based resins selected from the group consisting of polyalkylene terephthalate and a copolymerized polyester mainly containing polyalkylene terephthalate, and it is more preferable that the sheath part of the core-sheath conjugate fiber for artificial hair is comprised of a polyamide-based resin composition containing, specifically, as a main component resin, a polyamide-based resin mainly containing at least one selected from the group consisting of Nylon 6 and Nylon 66. In the core-sheath conjugate fiber for artificial hair, the "polyamide-based resin mainly containing at least one selected from the group consisting of Nylon 6 and Nylon 66" means a polyamide-based resin that contains Nylon 6 and/or Nylon 66 in an amount of 80 mol % or more.

In the core-sheath conjugate fiber for artificial hair, the "main component resin" means a resin with the highest content among resins contained in a resin composition. When the total amount of resins contained in the resin composition is taken as 100% by weight, the content of the main component resin may be more than 50% by weight, 70% by weight or more, 85% by weight or more, 90% by weight or more, 95% by weight or more, or 100% by weight.

The polyester-based resin composition constituting the core part may further contain other resins in addition to the polyester-based resin serving as the main component resin. When the total amount of resins in the polyester-based resin composition is taken as 100% by weight, the polyester-based resin serving as the main component resin is contained in an amount of preferably more than 50% by weight, more preferably 70% by weight or more, even more preferably 85% by weight or more, even more preferably 90% by weight or more, even more preferably 95% by weight or more, and particularly preferably 100% by weight. Examples of the other resins include a polyamide-based resin, a vinyl chloride-based resin, a modacrylic-based resin, a polycarbonate-based resin, a polyolefin-based resin, and a polyphenylenesulfide-based resin. These resins may be used alone or in a combination of two or more.

The polyamide-based resin composition constituting the sheath part may further contain other resins in addition to the polyamide-based resin serving as the main component resin. When the total amount of resins in the polyamide-based resin composition is taken as 100% by weight, the polyamide-based resin serving as the main component resin is contained in an amount of preferably more than 50% by weight, more preferably 70% by weight or more, even more preferably 85% by weight or more, even more preferably 90% by weight or more, even more preferably 95% by weight or more, and particularly preferably 100% by weight. Examples of the other resins include a polyester-based resin, a vinyl chloride-based resin, a modacrylic-based resin, a polycarbonate-based resin, a polyolefin-based resin, and a polyphenylenesulfide-based resin. These resins may be used alone or in a combination of two or more.

As necessary, the core-sheath conjugate fiber for artificial hair may contain various types of additives such as a flame retardant other than the brominated epoxy-based flame retardant, a flame retardant auxiliary, a heat-resistant agent, a stabilizer, a fluoresces, an antioxidant, and an antistatic agent.

Examples of the flame retardant other than the brominated epoxy-based flame retardant include a phosphorus-containing flame retardant and a bromine-containing flame retardant. Examples of the phosphorus-containing flame retardant include a phosphoric acid ester amide compound and an organic cyclic phosphorus-based compound. Examples of the bromine-containing flame retardant include: bromine-containing phosphoric acid esters such as pentabromotoluene, hexabromobenzene, decabromodiphenyl, decabromodiphenyl ether, bis(tribromophenoxy)ethane, tetrabromophthalic anhydride, ethylene bis(tetrabromophthalimide), ethylene bis(pentabromophenyl), octabromotrimethylphenylindan, and tris(tribromoneopentyl)phosphate; brominated polystyrenes; brominated polybenzyl acrylates; a brominated phenoxy resin; brominated polycarbonate oligomers; tetrabromobisphenol A and tetrabromobisphenol A derivatives such as tetrabromobisphenol A-bis (2,3-dibromopropyl ether), tetrabromobisphenol A-bis (allylether), and tetrabromobisphenol A-bis(hydroxyethyl ether); bromine-containing triazine compounds such as tris (tribromophenoxy)triazine; and bromine-containing isocyanuric acid compounds such as tris(2,3-dibromopropyl)isocyanurate. Of these compounds, it is preferable to use one or more selected from the group consisting of a phosphoric acid ester amide compound, an organic cyclic phosphorus-based compound, and a brominated phenoxy resin flame retardant, from the viewpoint of excellent flame retardance.

For example, it is preferable that the core part resin composition and/or the sheath part resin composition contains the brominated epoxy-based flame retardant in an amount of 5 parts by weight or more and 40 parts by weight or less with respect to 100 parts by weight of the main component resin, although there is no limitation thereto.

Examples of the flame retardant auxiliary include an antimony-based compound and a composite metal including antimony. Examples of the antimony-based compound include antimony trioxide, antimony tetraoxide, antimony pentoxide, sodium antimonate, potassium antimonate, and calcium antimonate. It is more preferable to use one or more selected from the group consisting of antimony trioxide, antimony pentoxide, and sodium antimonate, from the viewpoint of improving the flame retardance and the influence on a touch.

For example, it is preferable that the core part resin composition and/or the sheath part resin composition contains the flame retardant auxiliary in an amount of 0.1 parts by weight or more and 10 parts by weight or less with respect to 100 parts by weight of the main component resin, although there is no limitation thereto.

From the viewpoint of adjusting gloss and texture, it is possible to form appropriate asperities on the surface of the core-sheath conjugate fiber for artificial hair by performing treatment with chemicals or adding fine particles. Examples of the fine particles include composite particles mainly containing calcium carbonate, silicon oxide, titanium oxide, aluminum oxide, zinc oxide, talc, kaolin, montmorillonite, bentonite, mica, and silicon oxide. One type of these fine particles may be used alone, or a combination of two or more types of these fine particles may also be used.

Method for Producing Core-Sheath Conjugate Fiber

It is preferable to use a melt spinning method as the method for producing the core-sheath conjugate fiber for artificial hair. For example, in the case of a polyester-based resin composition, melt spinning is performed while the temperatures of an extruder, a gear pump, a nozzle, and the like are set to 250° C. or more and 300° C. or less, after which the extruded yarns are allowed to pass through a heated tube, cooled to a temperature not more than the glass transition point of the polyester-based resin, and wound up at a speed of 50 m/min or more and 5000 m/min or less, and thus extruded yarns (undrawn yarns) are obtained. In the case of a polyamide-based resin composition, melt spinning is performed while the temperatures of an extruder, a gear pump, a nozzle, and the like are set to 260° C. or more and 320° C. or less, after which the extruded yarns are allowed to pass through a heated tube, cooled to a temperature not more than the glass transition point of the polyamide-based resin, and wound up at a speed of 50 m/min or more and 5000 m/min or less, and thus extruded yarns (undrawn yarns) are obtained. During the melt spinning, it is possible to supply the core part resin composition from a core-part extruder, supply the sheath part resin composition from a sheath-part extruder, and extrude a molten polymer through a core-sheath conjugate spinning nozzle with a predetermined shape.

If the core-sheath conjugate fiber for artificial hair is comprised of a thermoplastic resin composition such as a polyester-based resin composition, it is also possible to produce the core-sheath conjugate fiber for artificial hair by pelletizing the thermoplastic resin composition through melt kneading using various types of ordinary kneaders, and then performing melt spinning using a core-sheath conjugate spinning nozzle. Moreover, the extruded yarns may also be cooled in a water bath containing cooling water to control the fineness. The temperature and length of the heated tube, the temperature and amount of cooling air applied, the temperature of the cooling water bath, the cooling time, and the winding speed can be adjusted appropriately according to the discharge amount of the polymer and the number of holes of the nozzle.

It is preferable that a pigment is contained at least in the core part resin composition to color the core part.

It is preferable that the extruded yarns (undrawn yarns) are hot drawn. The drawing may be performed by either a two-step method or a direct drawing method. In the two-step method, the extruded yarns are wound once, and then drawn. In the direct drawing method, the extruded yarns are drawn continuously without winding. The hot drawing may be performed by a single-stage drawing method or a multi-stage drawing method that includes two or more stages.

The heating means for the hot drawing may be a heating roller, a heat plate, a steam jet apparatus, or a hot water bath, which can be used in combination as desired.

It is also possible to make the touch and texture closer to those of human hair, by adding an oil solution such as a fiber treating agent and a softener to the core-sheath conjugate fiber for artificial hair. Examples of the fiber treating agent include a silicone-based fiber treating agent and a non-silicone-based fiber treating agent for improving the touch and the combing property.

The core-sheath conjugate fiber for artificial hair may be dyed in a dyeing step.

The core-sheath conjugate fiber for artificial hair may be subjected to gear crimping. In this case, it is possible to make the fiber gently curved and have a natural appearance, and to reduce the contact between fibers, thereby improving the combing property. In the gear crimping, typically, a fiber heated to the softening temperature or more is caused to pass through a portion between two meshing gears, so that the shape of the gears is transferred to the fiber, and the fiber is thus curved. Furthermore, as necessary, it is also possible to make a fiber curled in different shapes by heat-treating the core-sheath conjugate fiber for artificial hair at different temperatures during the fiber treatment processes.

Hair Ornament Product

The core-sheath conjugate fiber for artificial hair can be used for hair ornament products without particular limitation. For example, it is possible to use the core-sheath conjugate fiber for hair wigs, hairpieces, weaving hair, hair extensions, braided hair, hair accessories, doll hair, and the like.

The hair ornament product may be constituted only by the core-sheath conjugate fiber for artificial hair of one or more embodiments of the present invention, or may be comprised of the core-sheath conjugate fiber for artificial hair of one or more embodiments of the present invention combined with other fibers for artificial hair and natural fibers such as human hair and animal hair.

EXAMPLES

Hereinafter, one or more embodiments of the present invention will be more specifically described by way of examples. Note that one or more embodiments of the present invention are not limited to these examples.

The measuring methods and the evaluation methods used in the examples and comparative examples are as follows.

Single Fiber Fineness

The measurement was performed using an autovibro type fineness measuring apparatus "Denier Computer type DC-11" (manufactured by Search), and an average of measured values of 30 samples was calculated and taken as the single fiber fineness.

Core-to-Sheath Area Ratio

Fibers were bundled at room temperature and fixed with a shrinkage tube such that the fiber bundle (total fineness: 550 dtex) was not displaced, after which the bundle was cut in round slices using a cutter, and thus a fiber bundle for cross section observation was prepared. An image of this fiber bundle was captured using a laser microscope ("VK-9500" manufactured by Keyence Corporation) at a magnification of 500 times, and the core-to-sheath area ratio was evaluated based on the obtained photograph of a fiber cross section.

Color Tone Measurement

The color of each of the core part and the sheath part was acquired by observing the cross section using a digital microscope (VHX-60 manufactured by Keyence Corporation) and converting the color information into numerals to obtain the RGB value of the core part or the sheath part, and calculating L*a*b* from the RGB value.

Appearance Evaluation

With respect to the appearances of fibers of the examples and the comparative examples, sensory evaluation by professional hairstylists was performed in four stages below.

- A: The appearance is similar to that of human hair (the fiber has deep colors and a very good deep appearance)
- B: The appearance is substantially similar to that of human hair (the fiber has deep colors and a good deep appearance)
- C: The appearance is poor compared with that of human hair
- D: The appearance is bad and considerably poor compared with that of human hair

Example 1

20 parts by weight of a brominated epoxy-based flame retardant (product name "SR-T2MP" manufactured by Sakamoto Yakuhin Kogyo Co., Ltd.), 2 parts by weight of sodium antimonate (product name "SA-A" manufactured by NIHON SEIKO CO., LTD.), 2 parts by weight of a black pigment masterbatch (product name "PESM22367BLACK (20)" manufactured by Dainichiseika Color & Chemicals Mfg. Co., Ltd., pigment: 20% by weight, base resin: polyester-based resin), 0.7 parts by weight of a yellow pigment masterbatch (product name "PESM1001YELLOW (20)" manufactured by Dainichiseika Color & Chemicals Mfg. Co., Ltd., pigment: 20% by weight, base resin: polyester-based resin), and 0.5 parts by weight of a red pigment masterbatch (product name "PESM3005RED (20)" manufactured by Dainichiseika Color & Chemicals Mfg. Co., Ltd., pigment: 20% by weight, base resin: polyester-based resin) were added to 100 parts by weight of polyethylene terephthalate pellets (EastPET, product name "A-12" manufactured by East West Chemical Private Limited) dried to a moisture content of 100 ppm or less, the mixture was dry blended, then supplied to a twin-screw extruder, melt-kneaded at a barrel setting temperature of 280° C., and pelletized, then the pellets were dried to a moisture content of 100 ppm or less, and thus a polyester-based resin composition was obtained.

Next, 12 parts by weight of a brominated epoxy-based flame retardant (product name "SR-T2MP" manufactured by Sakamoto Yakuhin Kogyo Co., Ltd.), 2 parts by weight of sodium antimonate (product name "SA-A" manufactured by NIHON SEIKO CO., LTD.), 0.2 parts by weight of a black pigment masterbatch (product name "PESM22367BLACK (1)" manufactured by Dainichiseika Color & Chemicals Mfg. Co., Ltd., pigment: 20% by weight, base resin: polyester-based resin), 0.1 parts by weight of a yellow pigment masterbatch (product name "PESM1001YELLOW (20)" manufactured by Dainichiseika Color & Chemicals Mfg. Co., Ltd., pigment: 20% by weight, base resin: polyester-based resin), and 0.2 parts by weight of a red pigment masterbatch (product name "PESM3005RED (1)" manufactured by Dainichiseika Color & Chemicals Mfg. Co., Ltd., pigment: 20% by weight, base resin: polyester-based resin) were added to 100 parts by weight of Nylon 6 (product name "A1030BRL" manufactured by UNITIKA LTD.) dried to a moisture content of 1000 ppm or less, the mixture was dry blended, then supplied to a twin-screw extruder, melt-kneaded at a barrel setting temperature of 260° C., and pelletized, then the pellets were dried to a moisture content of 1000 ppm or less, and thus a polyamide-based resin composition was obtained.

Next, the polyester-based resin composition and the polyamide-based resin composition in the form of pellets were supplied to extruders, extruded from a concentric core-sheath conjugate spinning nozzle (number of pores: 120, pore diameter: 1.5 mm) at a set temperature of 280° C., and wound up at a speed of 40 to 200 m/min, and thus undrawn yarns of core-sheath conjugate fibers each including a core part comprised of the polyester-based resin composition and a sheath part comprised of the polyamide-based resin composition and having a core-to-sheath area ratio of core: sheath=5:5 were obtained.

The obtained undrawn yarns were drawn to 3 times while being wound up at a speed of 45 m/min using a heat roll at 85° C., and subsequently heat-treated by being wound up at a speed of 45 m/min using a heat roll heated to 200° C. After application of a polyether-based oil solution (product name "KWC-Q" manufactured by Marubishi Oil Chemical Corporation) in an amount of 0.20% omf (by oil pure weight percentage with respect to the dry fiber weight), the yarns were dried, and thus a core-sheath conjugate fiber (single fiber fineness: 58.3 dtex) having a cross sectional shape shown in FIG. 1 was obtained.

A hair bundle was produced by folding a fiber bundle of the obtained core-sheath conjugate fiber for artificial hair with a fiber length of 30 cm and a weight of 5 g at the middle, and fixing the folded fiber bundle with a cable tie. Next, a dye solution was prepared by adding 4 mL of a level dyeing agent (product name "Sera Gal P-BMO (10%)" manufactured by DyStar Japan Ltd.) to an aqueous solution of a yellow dispersed dye (product name "Terasil Yellow 2GW" manufactured by Huntsman Corporation) adjusted to 1.0% omf, and the pH of the solution was adjusted to 4 using acetic acid (2%). The dye solution was prepared in a pot dyeing machine, and the temperature of the solution at this time was set to 50° C. The produced hair bundle was immersed in the solution. Next, the temperature of the dye solution in which the hair bundle was immersed was raised to 130° C. at a rate of 1° C./min. Treatment was performed for 60 minutes at the dyeing temperature of 130° C., and then the fiber was taken out and washed with water for 10 minutes. After being washed, the fiber was dried for 1 hour at 60° C. using a uniform heating dryer.

Example 2

A core-sheath conjugate fiber (single fiber fineness: 61.5 dtex) was obtained in a similar way to that of Example 1, except that the resin used for the sheath part was changed to Nylon 66 (product name "AMILAN CM3001" manufactured by Toray Industries, Inc.), the barrel setting temperature during pelletization was changed to 280° C., the nozzle setting temperature was changed to 280° C., the core-to-sheath area ratio was changed to core:sheath=7:3, and the pigment masterbatches were not added to Nyon 66.

Example 3

A core-sheath conjugate fiber (single fiber fineness: 55.1 dtex) was obtained in a similar way to that of Example 1, except that the resin used for the sheath part was changed to Nylon 66 (product name "AMILAN CM3001" manufactured by Toray Industries, Inc.), the barrel setting temperature during pelletization was changed to 280° C., the nozzle setting temperature was changed to 280° C., and the core-to-sheath area ratio was changed to core:sheath=3:7.

Example 4

A core-sheath conjugate fiber (single fiber fineness: 58.3 dtex) was obtained in a similar way to that of Example 1, except that the resin used for the core part was changed to polybutylene terephthalate pellets (product name "NOVADURAN 5020" manufactured by Mitsubishi Chemical Corporation), the barrel setting temperature during pelletization was changed to 260° C., and the pigment masterbatches were not added to Nylon 6.

Example 5

A core-sheath conjugate fiber (single fiber fineness: 61.5 dtex) was obtained in a similar way to that of Example 1, except that a polyamide-based resin composition was used for the core part, a polyester-based resin composition was used for the sheath part, and the core-to-sheath area ratio was changed to core:sheath=7:3.

Comparative Example 1

A core-sheath conjugate fiber (single fiber fineness: 58.3 dtex) was obtained in a similar way to that of Example 1, except that the pigment masterbatches were not added to the polyester-based resin composition of the core part, and the pigment blending ratio of the polyamide-based resin composition of the sheath part was changed as follows: 2 parts by weight of the black pigment masterbatch (product name "PESM22367BLACK (20)" manufactured by Dainichiseika Color & Chemicals Mfg. Co., Ltd.), 0.7 parts by weight of the yellow pigment masterbatch (product name "PESM1001YELLOW (20)" manufactured by Dainichiseika Color & Chemicals Mfg. Co., Ltd.), and 0.5 parts by weight of the red pigment masterbatch (product name "PESM3005RED (20)" manufactured by Dainichiseika Color & Chemicals Mfg. Co., Ltd.).

Comparative Example 2

A core-sheath conjugate fiber (single fiber fineness: 58.3 dtex) was obtained in a similar way to that of Example 1, except that the pigment blending ratio of the polyamide-based resin composition of the sheath part was changed as follows: 2 parts by weight of the black pigment masterbatch (product name "PESM22367BLACK (20)" manufactured by Dainichiseika Color & Chemicals Mfg. Co., Ltd.), 0.7 parts by weight of the yellow pigment masterbatch (product name "PESM1001YELLOW (20)" manufactured by Dainichiseika Color & Chemicals Mfg. Co., Ltd.), and 0.5 parts by weight of the red pigment masterbatch (product name "PESM3005RED (20)" manufactured by Dainichiseika Color & Chemicals Mfg. Co., Ltd.).

Comparative Example 3

A core-sheath conjugate fiber (single fiber fineness: 58.3 dtex) was obtained in a similar way to that of Example 1, except that the pigment masterbatches were not added to the polyester-based resin composition of the core part.

Comparative Example 4

A core-sheath conjugate fiber (single fiber fineness: 58.3 dtex) was obtained in a similar way to that of Example 1, except that the dyeing step was not performed.

Comparative Example 5

A core-sheath conjugate fiber (single fiber fineness: 61.5 dtex) was obtained in a similar way to that of Example 2, except that the dyeing step was not performed.

With respect to the (dyed) core-sheath conjugate fibers of the examples and the comparative examples, the color tone of the core part and the color tone of the sheath part were measured as described above. The results are shown in Table 1 below. Also, with respect to the (dyed) core-sheath conjugate fibers of the examples and the comparative examples, the appearance was evaluated as described above. The results are shown in Table 1 below. Note that in Examples 1 to 5 and Comparative Examples 1 to 3, the color tone of the core part and the color tone of the sheath part were measured as described above before the dyeing step. The results are shown in Table 1 below. Note that the color of the core part and the color of the sheath part shown in Table 1 below are the colors before dyeing.

TABLE 1

| | Ex. 1 | Ex. 2 | Ex. 3 | Ex. 4 | Ex. 5 | Com. Ex. 1 | Com. Ex. 2 | Com. Ex. 3 | Com. Ex. 4 | Com. Ex. 5 |
|---|---|---|---|---|---|---|---|---|---|---|
| Core part: resin/color | PET/ black | PET/ black | PET/ black | PBT/ black | PA6/ black | PET/ white | PET/ black | PET/ white | PET/ black | PET/ black |
| Sheath part: resin/color | PA6/ beige | PA66/ white | PA66/ beige | PA6/ white | PET/ beige | PA6/ black | PA6/ black | PA6/ beige | PA6/ beige | PA66/ white |

TABLE 1-continued

| | | Ex. 1 | Ex. 2 | Ex. 3 | Ex. 4 | Ex. 5 | Com. Ex. 1 | Com. Ex. 2 | Com. Ex. 3 | Com. Ex. 4 | Com. Ex. 5 |
|---|---|---|---|---|---|---|---|---|---|---|---|
| Spun-dyeing of core part | | Yes | Yes | Yes | Yes | Yes | No | Yes | No | Yes | Yes |
| Spun-dyeing of sheath part | | Yes | No | Yes | No | Yes | Yes | Yes | Yes | Yes | No |
| Dyeing of core part | | Yes | Yes | Yes | Yes | Yes | Yes | Yes | Yes | No | No |
| Dyeing of sheath part | | Yes | Yes | Yes | Yes | Yes | Yes | Yes | Yes | No | No |
| Core-to-sheath ratio (area ratio) | | 5:5 | 7:3 | 3:7 | 5:5 | 7:3 | 5:5 | 5:5 | 5:5 | 5:5 | 7:3 |
| Color coordinates | L* | 5 | 6 | 8 | 9 | 7 | 53 | 5 | 66 | 13 | 12 |
| of core part | a* | −1 | 2 | −1 | −1 | −2 | −8 | 3 | 2 | 0 | 1 |
| | b* | 3 | 1 | 5 | 1 | 7 | 20 | 2 | 2 | 3 | 3 |
| Color coordinates | L* | 31 | 19 | 34 | 15 | 24 | 22 | 12 | 87 | 24 | 22 |
| of sheath part | a* | −7 | −3 | 2 | −2 | −3 | −5 | −5 | −2 | −1 | −2 |
| | b* | 16 | 1 | 1 | 35 | 9 | 10 | 11 | 87 | 1 | 3 |
| Color coordinates | L* | 13 | 12 | 13 | 14 | 15 | 59 | 11 | 95 | 13 | 12 |
| of core part before | a* | 0 | 1 | 1 | −2 | 7 | 0 | 1 | 2 | 0 | 1 |
| dyeing | b* | 3 | 3 | 5 | 4 | 11 | 0 | 1 | 15 | 3 | 3 |
| Color coordinates | L* | 24 | 22 | 31 | 20 | 21 | 28 | 19 | 85 | 24 | 22 |
| of sheath part before | a* | −1 | −2 | 1 | −1 | −5 | 3 | −1 | −1 | −1 | −2 |
| dyeing | b* | 1 | 3 | 4 | 2 | 3 | 4 | 2 | 25 | 1 | 3 |
| Appearance evaluation of core-sheath conjugate fiber | | A | B | A | B | A | C | D | D | C | C |

As can be seen from Table 1 above, in the core-sheath conjugate fibers of Examples 1 to 5, the core part had a lightness L* of 10 or less and the sheath part had a lightness L* of 15 or more, and accordingly, the core-sheath conjugate fibers had deep and natural colors similar to those of human hair and had good appearances. On the other hand, in the core-sheath conjugate fibers of Comparative Examples 1 and 3 to 5, the lightness L* of the core part was more than 10, and accordingly, the core-sheath conjugate fibers did not have deep and natural colors like those of human hair and did not have good appearances. In the core-sheath conjugate fiber of Comparative Example 2, the lightness L* of the sheath part was less than 15 and a combination of dark colors was adopted as the colors of the core part and the sheath part before dyeing, and accordingly, although the fiber was dyed, the fiber did not have deep and natural colors like those of human hair and did not have a good appearance.

One or more embodiments of the present invention may include at least the following embodiments, although there is no particular limitation thereto.

[1] A core-sheath conjugate fiber for artificial hair including a core part and a sheath part, wherein the core-sheath conjugate fiber for artificial hair is a colored fiber, and the core part has a lightness L* of 10 or less in the CIE1976 color space, and the sheath part has a lightness L* of 15 or more in the CIE1976 color space.

[2] The core-sheath conjugate fiber for artificial hair according to [1], wherein at least the core part contains a pigment.

[3] The core-sheath conjugate fiber for artificial hair according to [1] or [2], wherein the core part and the sheath part are both dyed.

[4] The core-sheath conjugate fiber for artificial hair according to any one of [1] to [3], wherein the core part of the core-sheath conjugate fiber for artificial hair contains one or more of polyester-based resins selected from the group consisting of polyalkylene terephthalate and a copolymerized polyester mainly containing polyalkylene terephthalate.

[5] The core-sheath conjugate fiber for artificial hair according to any one of [1] to [4], wherein the sheath part of the core-sheath conjugate fiber for artificial hair contains a polyamide-based resin mainly containing at least one selected from the group consisting of Nylon 6 and Nylon 66.

[6] The core-sheath conjugate fiber for artificial hair according to any one of [1] to [5], wherein the core part has a lightness L* of 8 or less in the CIE1976 color space, and the sheath part has a lightness L* of 24 or more in the CIE1976 color space.

[7] The core-sheath conjugate fiber for artificial hair according to any one of [1] to [6], wherein the core-sheath conjugate fiber for artificial hair has a core-to-sheath area ratio of core:sheath=1:9 to 9:1 in a fiber cross section.

[8] A hair ornament product including the core-sheath conjugate fiber for artificial hair according to any one of [1] to [7].

[9] The hair ornament product according to [8], wherein the hair ornament product is one selected from the group consisting of a hair wig, a hairpiece, weaving hair, a hair extension, braided hair, a hair accessory, and doll hair.

[10] A method for producing the core-sheath conjugate fiber for artificial hair according to any one of [1] to [7], including:

a step of melt spinning a core part resin composition and a sheath part resin composition using a core-sheath conjugate nozzle; and a step of dyeing the core-sheath conjugate fiber for artificial hair, wherein at least the core part resin composition contains a pigment.

[11] The method for producing the core-sheath conjugate fiber for artificial hair according to [10], wherein the pigment is comprised of three types of pigment masterbatches of black, red, and yellow.

LIST OF REFERENCE NUMERALS

1 Core-sheath conjugate fiber for artificial hair (cross section)

10 Core part

20 Sheath part

Although the disclosure has been described with respect to only a limited number of embodiments, those skilled in the art, having benefit of this disclosure, will appreciate that various other embodiments may be devised without departing from the scope of the present disclosure. Accordingly, the scope of the invention should be limited only by the attached claims.

What is claimed is:

1. A core-sheath conjugate fiber for artificial hair comprising:

a core part; and a sheath part, wherein:

the core-sheath conjugate fiber for artificial hair is a colored fiber, the core part has a lightness L* of 10 or less in a CIE1976 color space, and the sheath part has a lightness L* of 15 or more in the CIE1976 color space.

2. The core-sheath conjugate fiber for artificial hair according to claim 1, wherein at least the core part comprises a pigment.

3. The core-sheath conjugate fiber for artificial hair according to claim 1, wherein the core part and the sheath part are both dyed.

4. The core-sheath conjugate fiber for artificial hair according to claim 1, wherein the core part of the core-sheath conjugate fiber for artificial hair comprises one or more of polyester-based resins selected from the group consisting of polyalkylene terephthalate and a copolymerized polyester mainly containing polyalkylene terephthalate.

5. The core-sheath conjugate fiber for artificial hair according to claim 1, wherein the sheath part of the core-sheath conjugate fiber for artificial hair comprises a polyamide-based resin mainly containing at least one selected from the group consisting of Nylon 6 and Nylon 66.

6. The core-sheath conjugate fiber for artificial hair according to claim 1, wherein the core part has a lightness L* of 8 or less in the CIE1976 color space, and the sheath part has a lightness L* of 24 or more in the CIE1976 color space.

7. The core-sheath conjugate fiber for artificial hair according to claim 1, wherein the core-sheath conjugate fiber for artificial hair has a core-to-sheath area ratio of core:sheath=1:9 to 9:1 in a fiber cross section.

8. The core-sheath conjugate fiber for artificial hair according to claim 1, wherein the core part has a lightness L* of 5 or more in the CIE1976 color space.

9. The core-sheath conjugate fiber for artificial hair according to claim 1, wherein the sheath part has a lightness L* of 40 or less in the CIE1976 color space.

10. A hair ornament product comprising the core-sheath conjugate fiber for artificial hair according to claim 1.

11. The hair ornament product according to claim 10, wherein the hair ornament product is one selected from the group consisting of a hair wig, a hairpiece, weaving hair, a hair extension, braided hair, a hair accessory, and doll hair.

12. The hair ornament product according to claim 10, wherein at least the core part of the core-sheath conjugate fiber for artificial hair comprises a pigment.

13. The hair ornament product according to claim 10, wherein the core part and the sheath part of the core-sheath conjugate fiber for artificial hair are both dyed.

14. The hair ornament product according to claim 10, wherein the core part of the core-sheath conjugate fiber for artificial hair comprises one or more of polyester-based resins selected from the group consisting of polyalkylene terephthalate and a copolymerized polyester mainly containing polyalkylene terephthalate.

15. The hair ornament product according to claim 10, wherein the sheath part of the core-sheath conjugate fiber for artificial hair comprises a polyamide-based resin mainly containing at least one selected from the group consisting of Nylon 6 and Nylon 66.

16. The hair ornament product according to claim 10, wherein the core-sheath conjugate fiber for artificial hair has a core-to-sheath area ratio of core:sheath=1:9 to 9:1 in a fiber cross section.

17. The hair ornament product according to claim 10, wherein the core part of the core-sheath conjugate fiber for artificial hair has a lightness L* of 5 or more in the CIE1976 color space.

18. The hair ornament product according to claim 10, wherein the sheath part of the core-sheath conjugate fiber for artificial hair has a lightness L* of 40 or less in the CIE1976 color space.

19. A method for producing the core-sheath conjugate fiber for artificial hair according to claim 1, comprising:

a step of melt spinning a core part resin composition and a sheath part resin composition using a core-sheath conjugate nozzle; and a step of dyeing the core-sheath conjugate fiber for artificial hair, wherein at least the core part resin composition comprises a pigment.

20. The method for producing the core-sheath conjugate fiber for artificial hair according to claim 19, wherein the pigment is comprised of three types of pigment masterbatches of black, red, and yellow.

* * * * *